US012752948B2

(12) United States Patent
Bicer

(10) Patent No.: US 12,752,948 B2
(45) Date of Patent: Oct. 6, 2026

(54) BAG OPENING AND PRODUCT INSERTING MECHANISM

(71) Applicant: ISTANBUL TEKNIK UNIVERSITESI, Istanbul (TR)

(72) Inventor: Melih Bicer, Manisa (TR)

(73) Assignee: ISTANBUL TEKNIK UNIVERSITESI, Istanbul (TR)

( * ) Notice: Subject to any disclaimer, the term of this patent is extended or adjusted under 35 U.S.C. 154(b) by 0 days.

(21) Appl. No.: 19/148,731

(22) PCT Filed: Jan. 16, 2024

(86) PCT No.: PCT/TR2024/050031

§ 371 (c)(1),
(2) Date: Jul. 17, 2025

(87) PCT Pub. No.: WO2024/155262

PCT Pub. Date: Jul. 25, 2024

(65) Prior Publication Data

US 2026/0217406 A1 Jul. 30, 2026

(30) Foreign Application Priority Data

Jan. 17, 2023 (TR) ..... 2023/000546

(51) Int. Cl.
*B65B 43/00* (2006.01)
*B65B 43/30* (2006.01)
*B65B 43/34* (2006.01)

(52) U.S. Cl.
CPC ..... *B65B 43/34* (2013.01)

(58) Field of Classification Search
CPC ..... B65B 43/26; B65B 43/16; B65B 43/28; B65B 43/00
See application file for complete search history.

(56) References Cited

U.S. PATENT DOCUMENTS 3,747,298 A 7/1973 Lieberman
4,174,599 A * 11/1979 Callet ..... B65B 1/22 141/93
4,517,788 A * 5/1985 Scheffers ..... B65B 1/02 53/375.4
4,537,584 A * 8/1985 Everman ..... B31B 50/00 493/93
4,874,354 A * 10/1989 Johnson ..... B65B 43/30 53/385.1
5,142,840 A * 9/1992 Cappi ..... B65B 43/30 53/384.1

(Continued)

FOREIGN PATENT DOCUMENTS

CN 212048118 U 12/2020
CN 215514399 U 1/2022

*Primary Examiner* — Gloria R Weeks
(74) *Attorney, Agent, or Firm* — Bayramoglu Law Offices LLC

(57) ABSTRACT

The provided is a mechanism which enables the opening of the mouth of the bags and placing products inside. With the mechanism, it is possible to take the suspended bag, to stretch the bag from the handle portions of the bag, to make the bag ready for loading by stretching the bag from 4 different points, to restore the bag after loading, to bring the handles of the bag together and to perform the loading operations to other transfer organs in order to deliver it to the next stage of autonomisation.

5 Claims, 10 Drawing Sheets

(56) References Cited

U.S. PATENT DOCUMENTS

| | | | | |
|---|---|---|---|---|
| 5,802,817 | A * | 9/1998 | Hood | B65B 43/28 53/469 |
| 9,689,601 | B2 * | 6/2017 | Hsu | F25C 5/20 |
| 10,273,042 | B1 * | 4/2019 | Kolodziey | B31B 50/003 |
| 2005/0102974 | A1 | 5/2005 | Reed et al. | |
| 2019/0127100 | A1 * | 5/2019 | Matsumura | B65B 43/36 |
| 2020/0115082 | A1 * | 4/2020 | Hess | B65B 43/123 |

* cited by examiner

BAG OPENING AND PRODUCT INSERTING MECHANISM

CROSS REFERENCE TO THE RELATED APPLICATIONS

This application is the national phase entry of International Application No. PCT/TR2024/050031, filed on Jan. 16, 2024, which is based upon and claims priority to Turkish Patent Application No. 2023/000546, filed on Jan. 17, 2023, the entire contents of which are incorporated herein by reference.

TECHNICAL FIELD

The invention relates to a mechanism which enables the opening of the mouth of the bags and placing products inside.

BACKGROUND

In the state of the art, during delivery by drone, the bags are opened by pressing air into them or the products are left only in cardboard boxes without using any bags.

In the new drone delivery sector, cardboard boxes with rigid structures are preferred due to the geometric and material structure of the bag, which can wrinkle and is difficult to remain stable. Cardboard boxes cannot be used in unmanned vending systems due to their cost disadvantages and space disadvantages.

In the Chinese Utility Model document numbered CN215514399U in the state of the art, a motor-controlled bag opening mechanism is disclosed. In the relevant mechanism, the sliding parts move by sliding on the arm with the rotation of the shaft. The bag opening process is carried out by the movement of the parts at the ends of the inclined arms fixed on the sliding part.

In the Chinese Utility Model document numbered CN212048118U in the state of the art, a bag opening type feeding mechanism belonging to the technical field of automatic packaging equipment is disclosed.

When the existing works in the art were examined, it was necessary to realise the mechanism of the invention, which enables a suspended bag to be taken, the bag to be stretched from the handle portions, the bag to be made ready for loading by stretching the bag from 4 different points, the bag to be restored after loading, the handles of the bag to be brought together and the loading operations to be carried out in order to deliver the bag to the next stage of autonomisation.

SUMMARY

The object of the present invention is to realise a mechanism for taking a suspended bag, stretching the bag from the handle portions of the bag and making the bag ready for loading by stretching the bag at 4 different points.

It is a further object of the present invention to provide a mechanism for restoring the bag after loading, and for carrying out the loading operations by bringing the handles of the bag together for delivery to the next stage of autonomisation.

BRIEF DESCRIPTION OF THE DRAWINGS

The mechanism for opening the mouth of the bags and inserting products therein, which is realised to achieve the objects of the present invention, is shown in the accompanying figures.

These figures.

Figure 1:
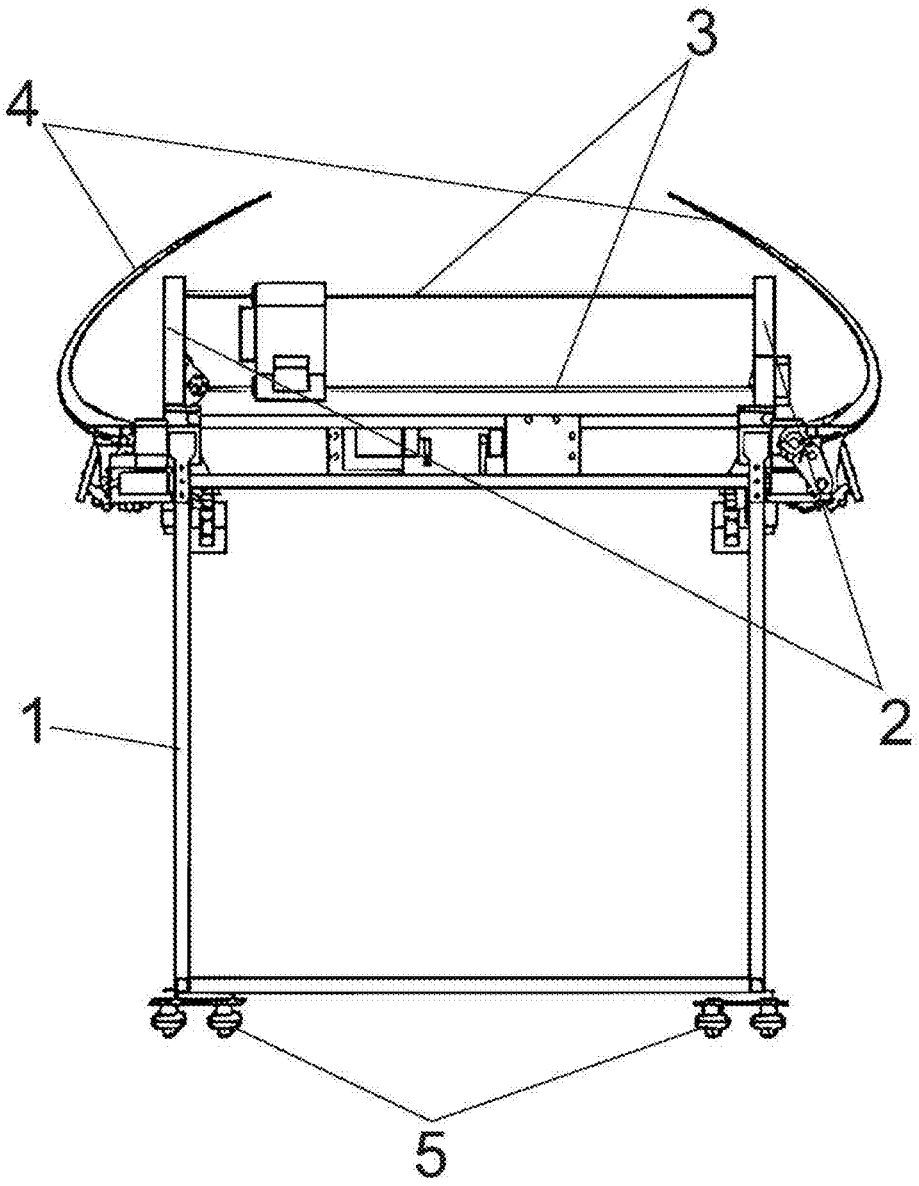
FIG. 1: Front view of the mechanism according to the invention.
Figure 2:
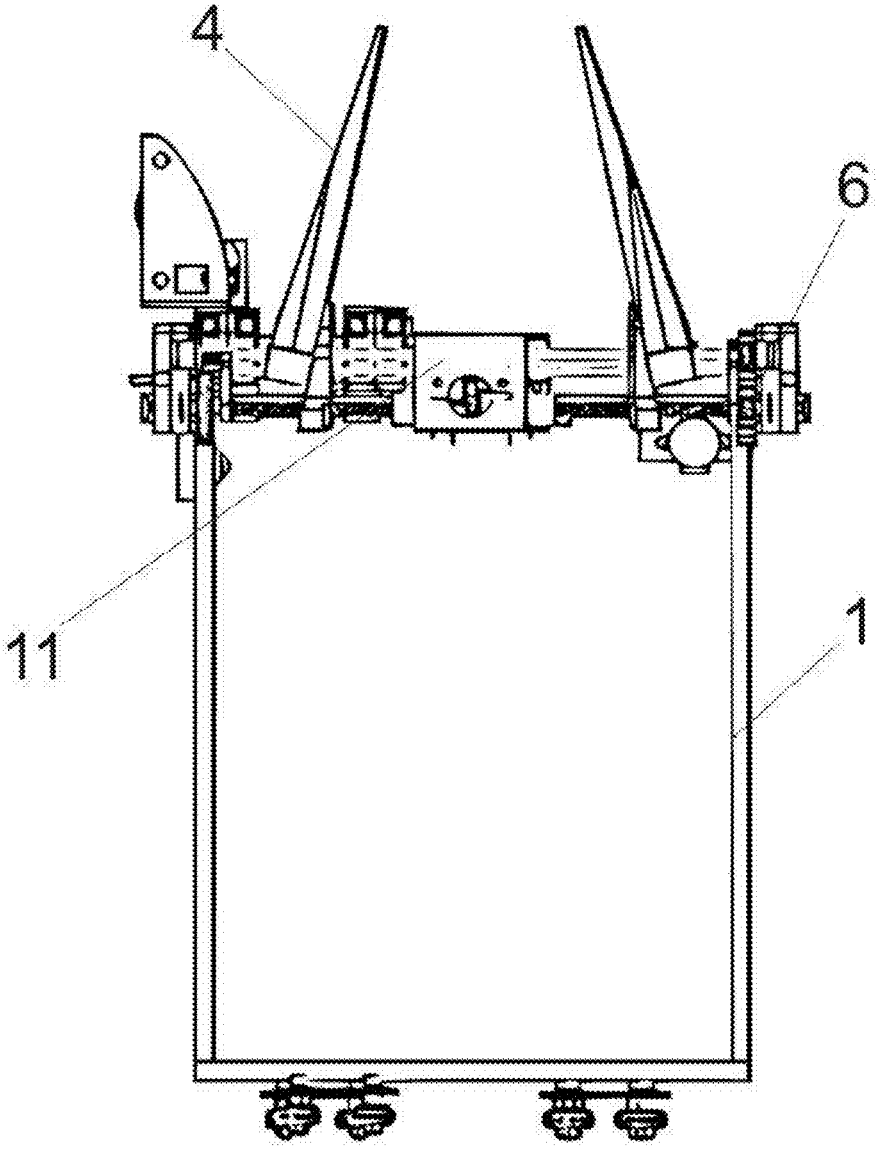
FIG. 2: Side view of the mechanism according to the invention.
Figure 3:
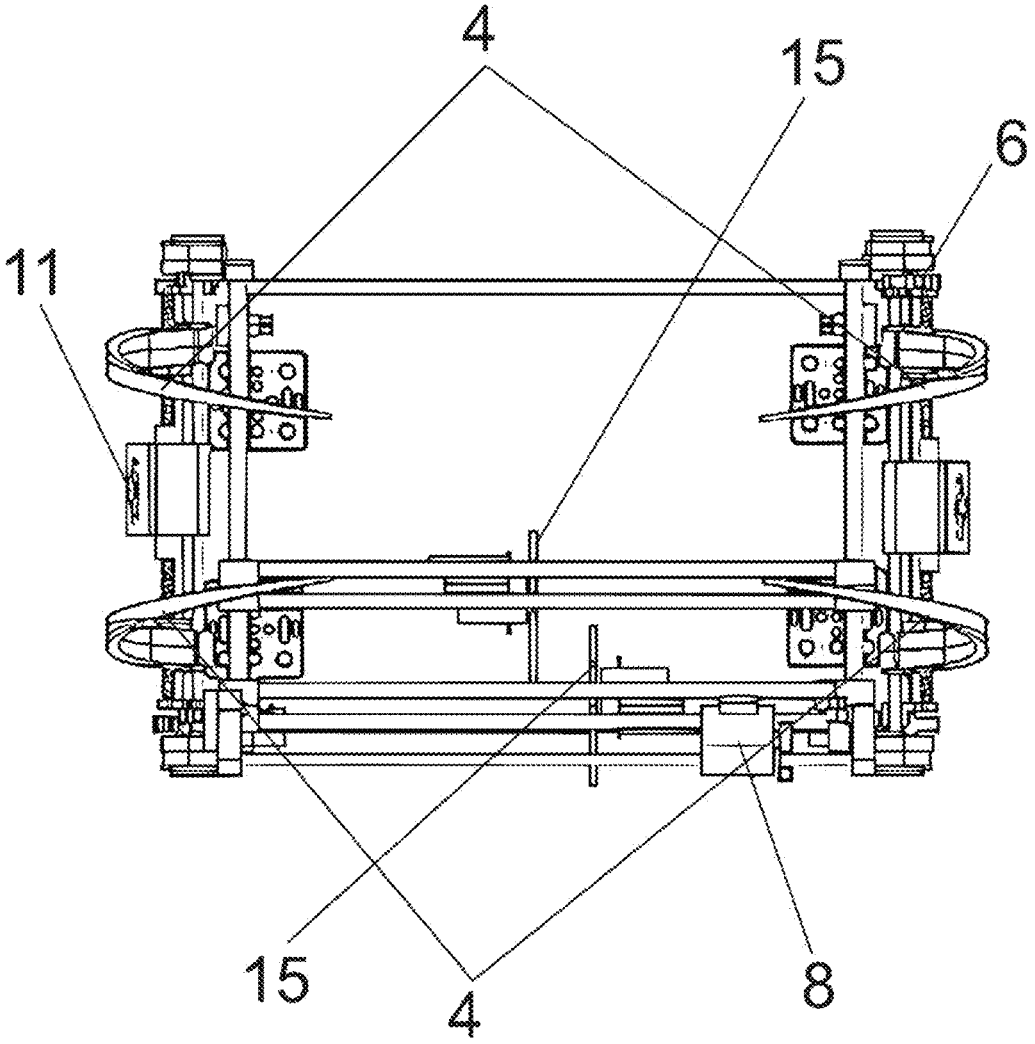
FIG. 3: Top view of the mechanism according to the invention.
Figure 4:
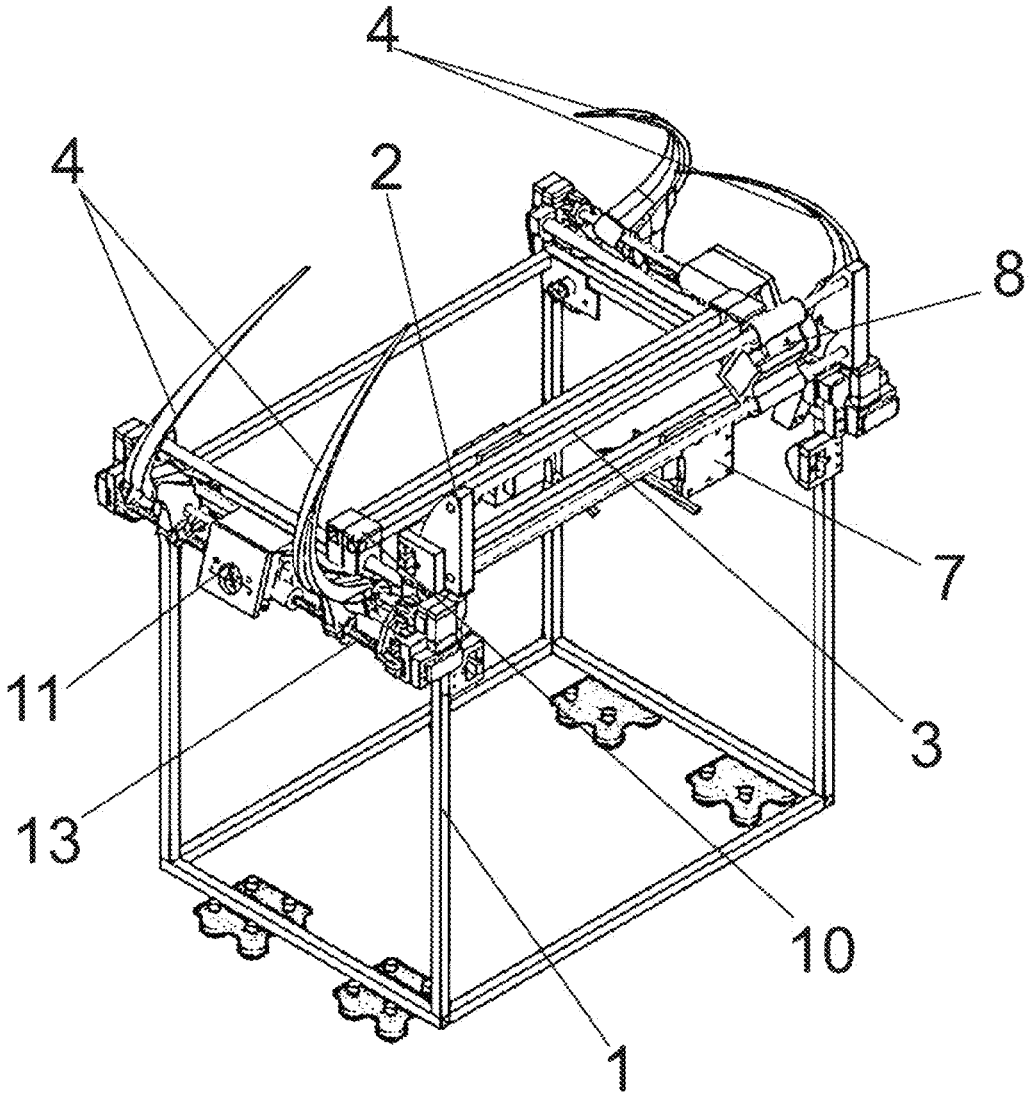
FIG. 4: Perspective view of the mechanism according to the invention.
Figure 5:
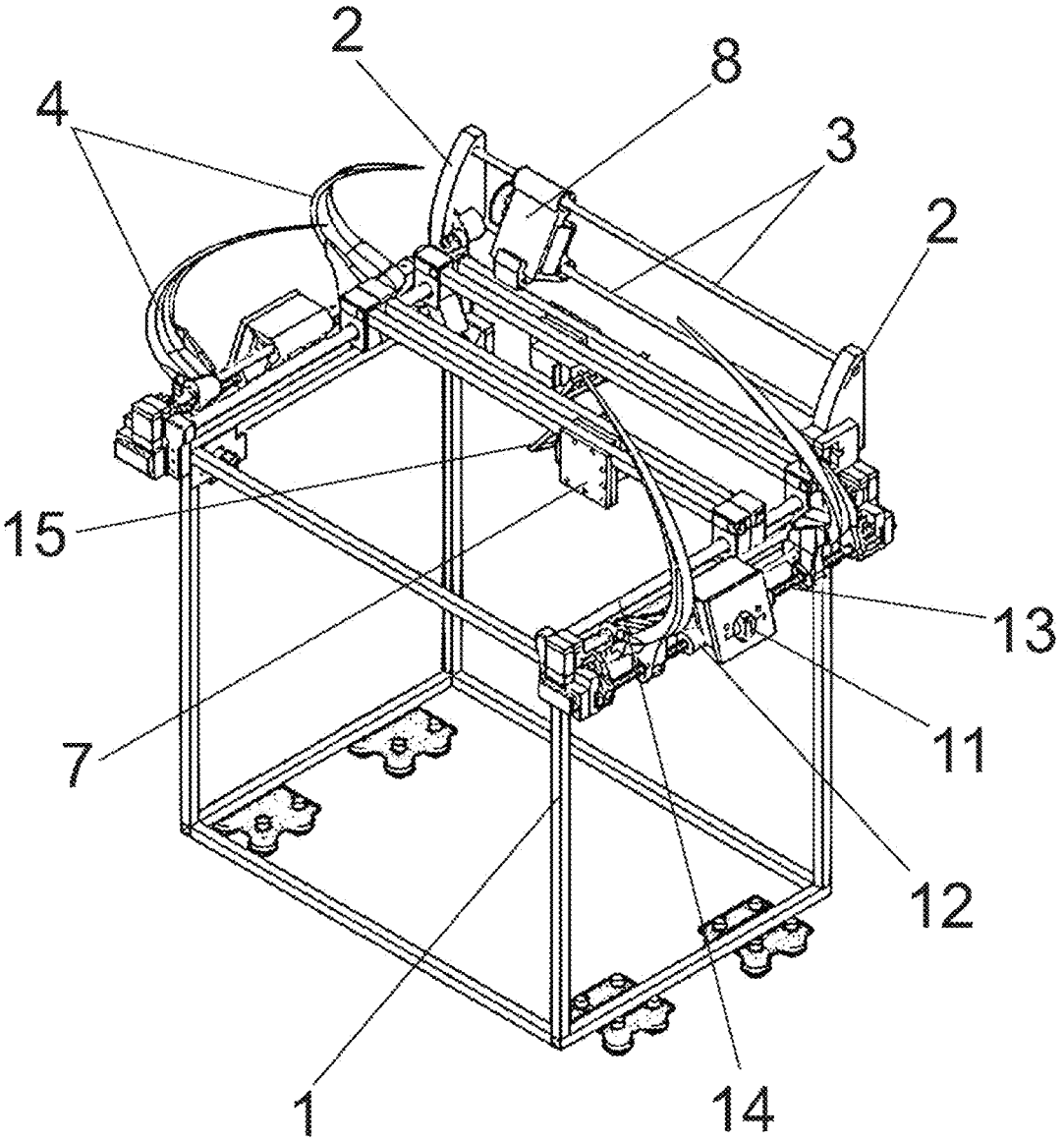
FIG. 5: Perspective view from a different angle of the mechanism according to the invention.
Figure 6:
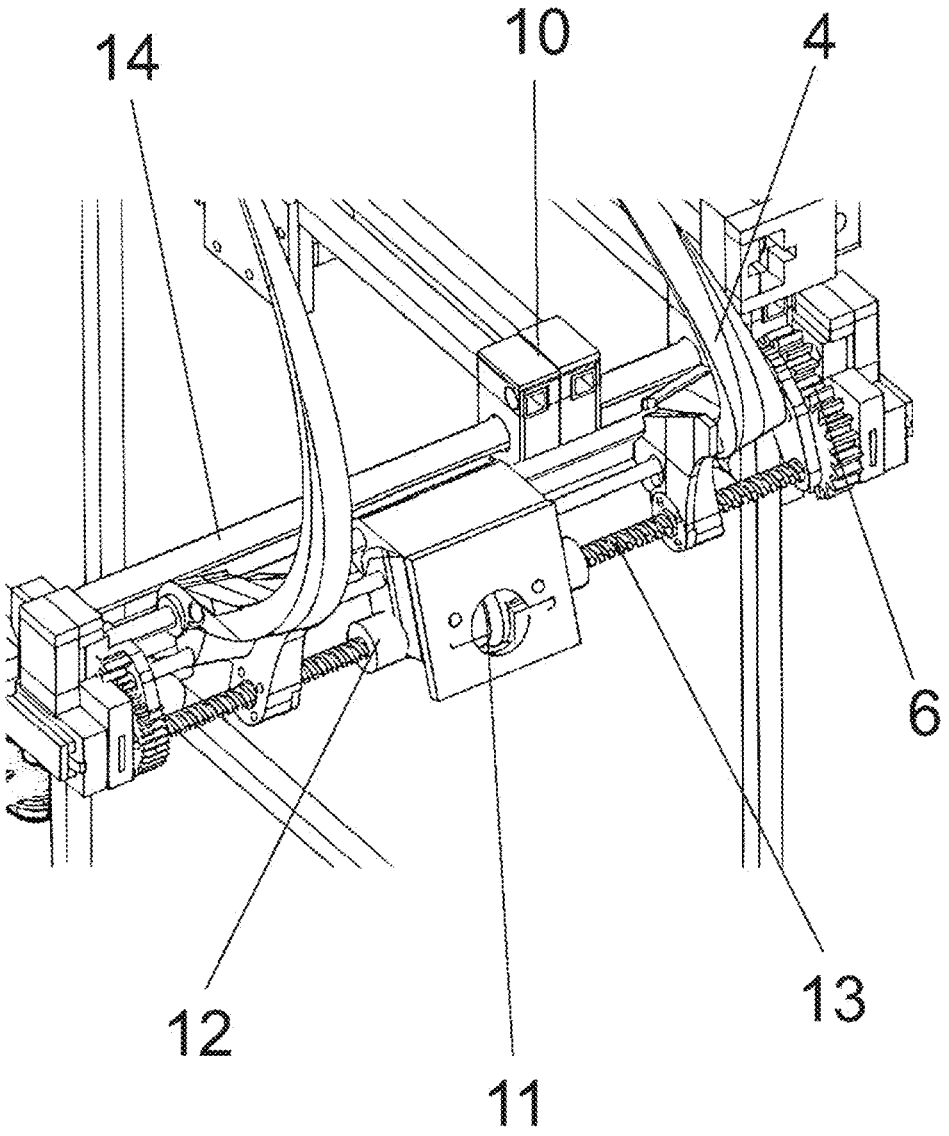
FIG. 6: Detailed view of the motor sockets of the mechanism according to the invention.
Figure 7:
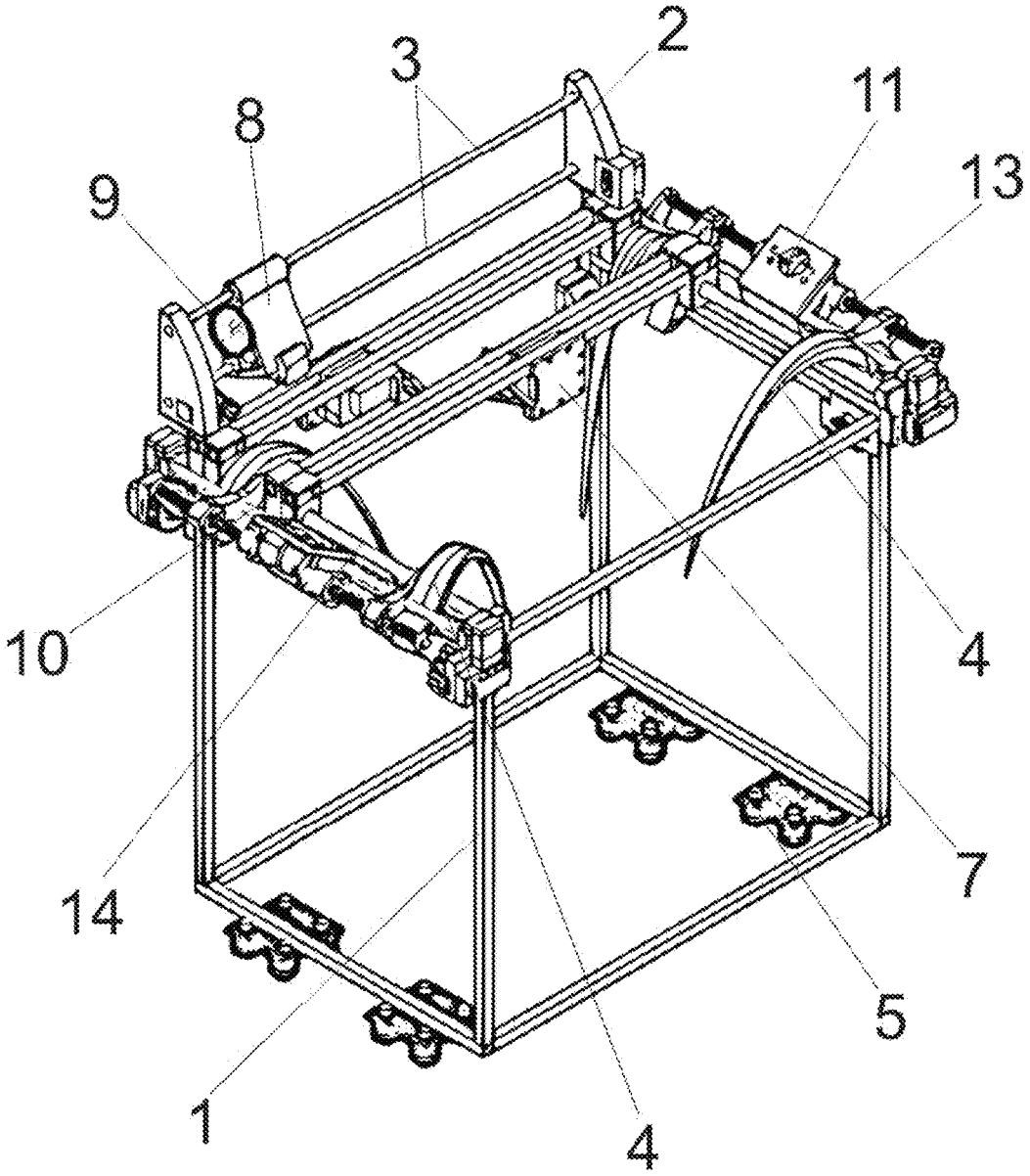
FIG. 7: Perspective view from another different angle of the mechanism according to the invention.
Figure 8:
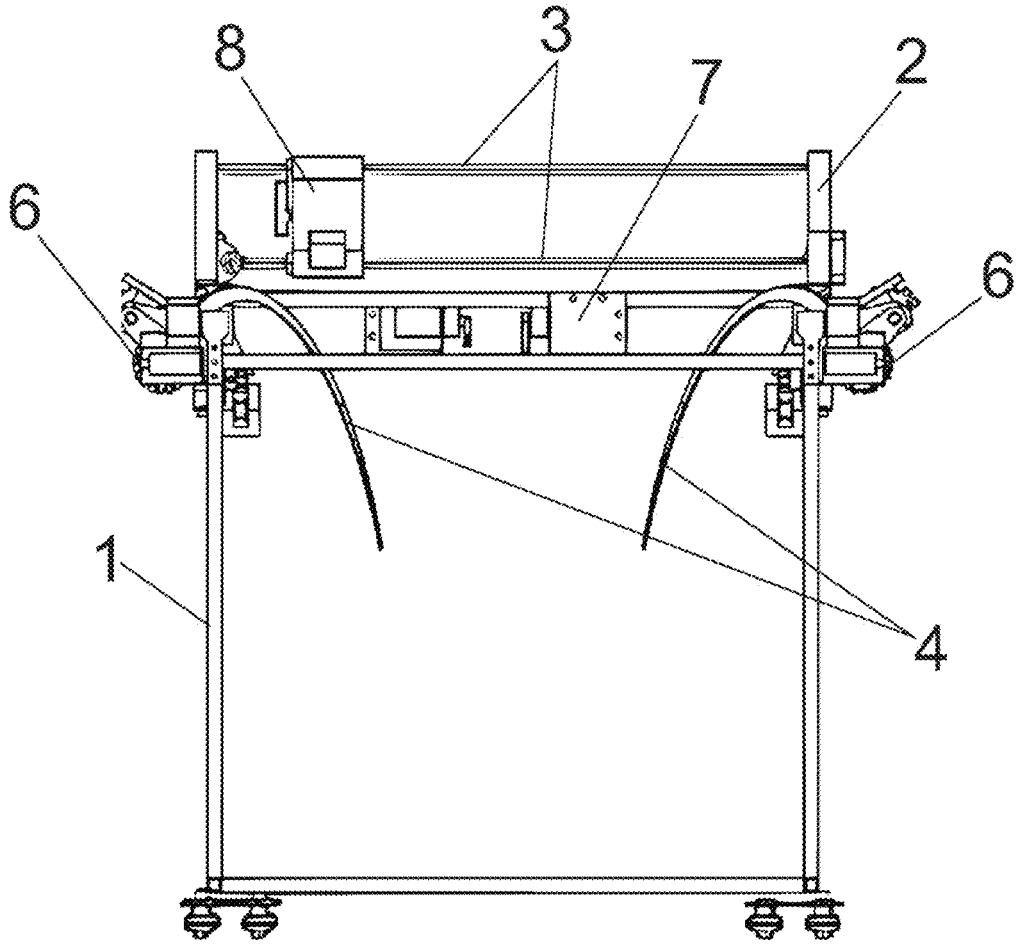
FIG. 8: Front view of the mechanism according to the invention with the stretching arms in a different position.
Figure 9:
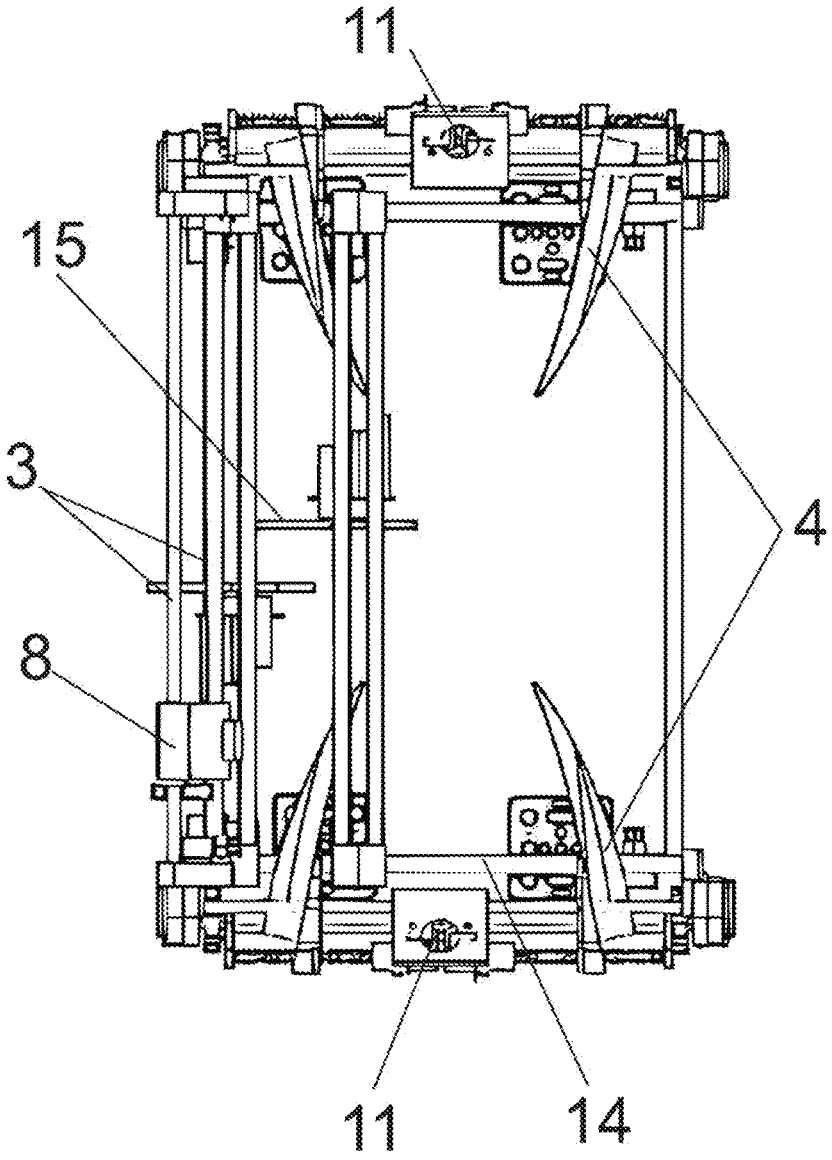
FIG. 9: Top view of the mechanism according to the invention with the stretching arms in a different position.
Figure 10:
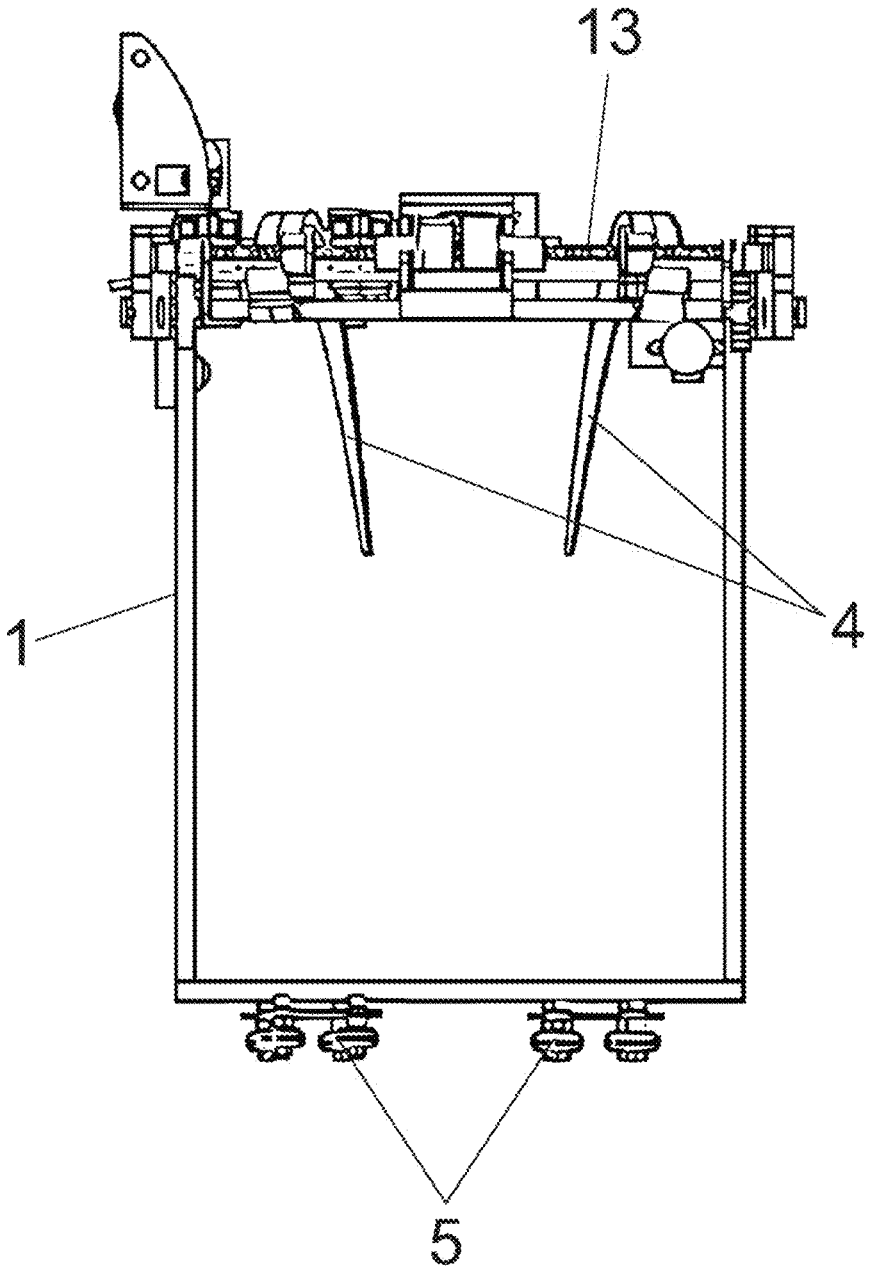
FIG. 10: Side view of the mechanism according to the invention with the stretching arms in a different position.

The parts in the figures are numbered separately and the equivalents of these numbers are given below.

1. Body
2. Upper shaft mount
3. Upper shaft
4. Stretching arm
5. Wheel
6. Movable gear train
7. Stepper motor seat
8. Sliding motor
9. Toothed wheel
10. Bearing and metal housing
11. Motor seat
12. Coupling
13. Threaded rod
14. Lower shaft
15. Bag gripper

DETAILED DESCRIPTION OF THE EMBODIMENTS

The invention relates to a mechanism which enables the opening of the mouth of the bags and placing products inside, comprises

- upper shaft mounts (2) positioned opposite each other on the body (1),
- upper shafts (3) positioned between the upper shaft mounts (2),
- a sliding motor (8) positioned on the upper shafts (3), which can move to the right and left on the upper shafts (3) and enables the products to fall into the bag,
- stretching arms (4), which are located on the threaded rod (13) and enable the bag to be stretched by pressing the bag from the inside out by rotation of the threaded rod (13),
- wheels (5) positioned under the body (1) and allowing the mechanism to be moved,
- a movable gear train (6) located on the body (1), connected to the threaded rod (13) and enabling the opening and closing of the stretching arms (4),
- a motor seat (11) located on the threaded rod (13),
- a coupling (12) connecting the motor seat (11) with the threaded rod (13),
- a lower shaft (14) positioned perpendicular to the upper shaft (3), a bearing and metal housing (10) connected to the lower shaft (14) and providing movement on the lower shaft (14), a stepper motor seat (7) connected to the bearing and metal housing (10) in which stepper motors are placed to hold the bags, a bag gripper (15) connected to the ends of the stepper motor seats (7) enabling the opening of the mouth of the bag by sliding the stepper motor seats (7) on the lower shaft (14).

In the mechanism according to the invention, the first operation is carried out by the stepper motor seats (7) located in the centre of the system connected to the bearing and metal housing (10) and the bag grippers (15) connected at the ends, which take the bag from a hanger. The bag grippers (15) have a hook-like structure in terms of their shape and pull the bag they hold to themselves. When the bags are held by their handles, the arm to which the bearing and metal seat (10) are connected slides on the lower shafts (14) towards the other side and enables the opening of the mouth of the bag.

There are 4 stretching arms (4) in the mechanism. These ensure that the incoming bag is stretched by pressing it from the inside out. The stretching arms (4) are initially in an upward-facing position and close to each other. When the bag enters the system, the stretching arms (4) move down from the upward position and assume a closed position. To do this, the movable gear train (6) must be rotated by means of a stepper motor. The stretching arms (4), which enter the bag, move away from each other and allow the bag to be stretched from the corners. For this to happen, threaded rods (13) rotate. This rotation process is driven by motors. Wheels (5) are the parts that work to change the position of the system.

In the mechanism according to the invention, the gripping parts (15) connected to the motor tip enable the handles of the bag to be held with the rotational movement made by stepper motors capable of moving between 0 and 120 degrees.

Said gripping operation, results in the gripping of the bag passing to the end of the gripping parts (15) with its inclined structure and aligning it with the centre of gravity of the stepper motor.

In this way, no torque is created during the bag filling process and no load is created to forcibly rotate the stepper motors.

In the implementation phase of the mechanism according to the invention, there is a timing belt in each product section of the vending machine in which shelf-like structures are used as a storage system. In the mechanism of the invention, there is a toothed wheel (9) connected to the sliding motor (8), which rotates the timing belt and allows a product on the shelf to fall into the bag.

With the movement of this belt, the products are pulled forward by pushing the product at the back. The products pulled to the front are dropped into the gap, i.e. into the bag.

What is claimed is:

1. A mechanism, wherein the mechanism enables opening of a mouth of bags and placing products inside, and the mechanism comprises upper shafts positioned between upper shaft mounts, a sliding motor positioned on the upper shafts, wherein the sliding motor is allowed to move to right and left on the upper shafts and enables the products to fall into the bag, stretching arms, wherein the stretching arms are located on a threaded rod and enable the bag to be stretched by pressing the bag from inside out by rotation of the threaded rod, a movable gear train located on a body, connected to the threaded rod and enabling opening and closing of the stretching arms, a lower shaft positioned perpendicular to the upper shaft, a bearing and metal housing connected to the lower shaft and providing movement on the lower shaft, stepper motor seat connected to the bearing and metal housing where stepper motors are placed to hold the bags, a bag gripper connected to ends of the stepper motor seats enabling the opening of the mouth of the bag by sliding the stepper motor seats on the lower shaft.

2. The mechanism according to claim 1, comprising the upper shaft mounts positioned opposite each other on the body.

3. The mechanism according to claim 1, comprising wheels positioned under the body and allowing the mechanism to be moved.

4. The mechanism according to claim 1, comprising a motor seat located on the threaded rod.

5. The mechanism according to claim 4, comprising a coupling connecting the motor seat with the threaded rod.

* * * * *